US008087661B2

(12) United States Patent
Iwami et al.

(10) Patent No.: US 8,087,661 B2
(45) Date of Patent: Jan. 3, 2012

(54) PAPER-SHEET FEEDING DEVICE

(75) Inventors: Toyofumi Iwami, Himeji (JP); Hidehiko Matsushita, Takasago (JP)

(73) Assignee: Glory Ltd., Himeji-Shi (JP)

( * ) Notice: Subject to any disclaimer, the term of this patent is extended or adjusted under 35 U.S.C. 154(b) by 19 days.

(21) Appl. No.: 12/442,427

(22) PCT Filed: Dec. 13, 2006

(86) PCT No.: PCT/JP2006/324828

§ 371 (c)(1),
(2), (4) Date: Mar. 23, 2009

(87) PCT Pub. No.: WO2008/072317

PCT Pub. Date: Jun. 19, 2008

(65) Prior Publication Data

US 2010/0038842 A1 Feb. 18, 2010

(51) Int. Cl.
*B65H 3/52* (2006.01)

(52) U.S. Cl. ..... 271/121

(58) Field of Classification Search ..... 271/121, 271/124, 125

See application file for complete search history.

(56) References Cited

U.S. PATENT DOCUMENTS

| | | | | |
|---|---|---|---|---|
| 4,801,134 A | | 1/1989 | Yokoyama et al. | |
| 5,351,945 A | | 10/1994 | Asakawa et al. | |
| 5,692,744 A | * | 12/1997 | Funato | 271/242 |
| 5,725,208 A | | 3/1998 | Miyauchi | |
| 6,983,880 B2 | * | 1/2006 | Graef et al. | 235/379 |
| 2007/0194522 A1 | * | 8/2007 | Cheng et al. | 271/272 |

FOREIGN PATENT DOCUMENTS

| | | | |
|---|---|---|---|
| EP | 1 122 197 | | 8/2001 |
| JP | 64-038346 A1 | | 2/1989 |
| JP | 01038346 A | * | 2/1989 |
| JP | 03-128835 A1 | | 5/1991 |
| JP | 05-008878 A1 | | 1/1993 |
| JP | 08-277046 A1 | | 10/1996 |
| JP | 09-208070 A1 | | 8/1997 |

* cited by examiner

*Primary Examiner* — Michael McCullough

(74) *Attorney, Agent, or Firm* — Burr & Brown

(57) ABSTRACT

A torque limiter between a pressure roller and shaft, which is configured to allow the pressure roller to rotate in a feed-out direction of a paper-sheet P, relative to the shaft, when a torque greater than a predetermined torque T is applied to the pressure roller along a circumferential direction thereof, while interlocking the pressure roller with the shaft when the torque applied to the pressure roller along the circumferential direction thereof is less than the predetermined torque. Further, the predetermined torque is set less than frictional torque N3 directly generated between a feed roller friction part and a pressure roller friction part at a nip part N, while being set greater than both the frictional torque N1 generated between the pressure roller friction part of the pressure roller and the paper-sheet P at the nip part N and the frictional torque N4 generated between a pair of paper-sheets P at the nip part.

3 Claims, 3 Drawing Sheets

PAPER-SHEET FEEDING DEVICE

FIELD OF THE INVENTION

The present invention relates to a paper-sheet feeding device configured for successively feeding a plurality of paper-sheets stored in a paper-sheet storing unit, to an outside, one by one, and in particular relates to the paper-sheet feeding device that can simplify the entire construction thereof, reduce the cost and increase a feeding speed of the paper-sheets.

BACKGROUND OF THE INVENTION

The paper-sheet feeding device used for a banknote counter or the like is configured for successively feeding the paper-sheets (e.g., banknotes or the like) stacked therein, one by one, so as to carry them to the outside.

Typically, in such a paper-sheet feeding device as described above, a feed roller and a thickness adjustment member are provided to a feeding unit for the paper-sheets, with a gap corresponding to thickness of one paper-sheet. Thus, the paper-sheet fed into the feeding unit can be fed out therefrom, one by one, while being controlled upon passing through the gap between the feed roller and the thickness adjustment member. However, in such a paper-sheet feeding device, when the paper-sheets are inserted and stuck between the feed roller and the thickness adjustment member, while being overlapped in two sheets or more, the feed roller will be in a locked state, and rotation of the feed roller will be stopped. In such a case, it will take unduly time and labor to remove such stuck paper-sheets.

To solve this problem, the paper-sheet feeding device as disclosed in JP5-8878A has been proposed. Now, such a conventional paper-sheet feeding device is described, with reference to FIGS. 4 and 5. FIG. 4 is a side view schematically showing construction of the conventional paper-sheet feeding device, and FIG. 5 is a diagram for schematically illustrating a state when the paper-sheet is fed out from the paper-sheet feeding device shown in FIG. 4. In FIG. 5, FIG. 5(*a*) is a schematic view showing a state before the paper-sheet is fed out, FIG. 5(*b*) is a schematic view showing a state when one paper-sheet is fed to a nip part between the feed roller and a pressure roller, and FIG. 5(*c*) is a schematic view illustrating a state when two paper-sheets are fed to the nip part between the feed roller and the pressure roller, while being overlapped with each other.

As shown in FIG. 4, the conventional paper-sheet feeding device includes a storing unit 90 configured for storing therein the plurality of paper-sheets P in a stacked condition, a kicker roller 80 provided to a bottom portion of the storing unit 90 and adapted for kicking the paper-sheets P stored in the storing unit 90, to the outside, one by one, and the feed roller 60 and pressure roller 70, each adapted for feeding out the paper-sheet P kicked out from the storing unit 90 by the kicker roller 80. The feed roller 60 is provided to be in contact with and pressed against the pressure roller 70, while the nip part N is formed between the feed roller 60 and the pressure roller 70.

The feed roller 60, as shown in FIG. 4, is configured to be continuously rotated, in a direction designated by an arrow as depicted in FIG. 4, upon performing a feed-out operation for the paper-sheet P. The feed roller 60 includes a base part 62 having a substantially disk-like shape and formed from, for example, a plastic or metal. The base part 62 has a rubber (not shown) provided around the whole outer circumference thereof. Along an axis of the feed roller 60, a feed roller shaft 61 for pivoting the feed roller 60 is provided to extend in a vertical direction relative to the sheet of FIG. 4. This feed roller 60 can serve to feed out each paper-sheet P kicked out by the kicker roller 80, while being in contact with a surface thereof.

The pressure roller 70, as shown in FIG. 4, includes a base part 72 having a substantially disk-like shape and formed from, for example, a suitable plastic or metal. Further, the base part 72 has another rubber (not shown) provided around the whole outer circumference thereof. Along the axis of the pressure roller 70, a pressure roller shaft 71 for pivoting the pressure roller 70 is provided to extend in the vertical direction relative to the sheet of FIG. 4. The nip part N is formed between the rubber provided around the base part 72 of the pressure roller 70 and the rubber provided around the base part 62 of the feed roller 60. Additionally, a torque limiter 73 is provided between the base part 72 of the pressure roller 70 and the pressure roller shaft 71. The torque limiter 73 is provided to allow the pressure roller 70 to be rotated, in a circumferential direction thereof (specifically, in a feed-out direction of the paper-sheet P), relative to the pressure roller shaft 71, when torque greater than a predetermined torque is applied to the pressure roller 70 along the circumferential direction thereof. Meanwhile, this torque limiter 73 interlocks the pressure roller 70 with the pressure roller shaft 71, when the torque that is less than the predetermined torque is applied to the pressure roller 70 along the circumferential direction thereof.

Furthermore, a pressure roller shaft drive transmission mechanism (not shown) adapted for driving the pressure roller shaft 71 to be continuously rotated is provided to the pressure roller shaft 71. Specifically, this pressure roller shaft drive transmission mechanism is provided to rotate the pressure roller shaft 71, at any time, at a low speed, in a direction reverse to the feed-out direction of the paper-sheet P, i.e., in the direction designated by another arrow as depicted in FIG. 4. Thus, the pressure roller 70 will be rotated in the feed-out direction of the paper-sheet P, against the rotation of the pressure roller shaft 71, when the torque applied to the pressure roller 70 in the circumferential direction thereof is greater than the predetermined torque, due to friction against the feed roller 60 or the like (see FIG. 4). Meanwhile, the pressure roller 70 will be interlocked with the pressure roller shaft 71 and rotated in the direction reverse to the feed-out direction of the paper-sheet P, when the torque applied to the pressure roller 70 in the circumferential direction thereof is less than the predetermined torque.

Next, the feed-out operation for the paper-sheet P, at the nip part N in such a conventional paper-sheet feeding device as shown in FIG. 4, will be described in more detail, with reference to FIG. 5. It is noted that the feed-out direction of the paper-sheet P is a right direction in FIG. 5.

FIG. 5(*a*) is a diagram schematically showing one exemplary state in which no paper-sheet P is fed to the nip part N between the feed roller 60 and the pressure roller 70. In this state, the feed roller 60 is continuously rotated in the feed-out direction of the paper-sheet P. Since the feed roller 60 is pressed against the pressure roller 70, a torque for driving the pressure roller 70 to be rotated together with the feed roller 60 is transmitted to the pressure roller 70 from the feed roller 60. This torque that is applied to rotate the pressure roller 70 (i.e., the torque applied to the pressure roller 70 in the circumferential direction thereof) is set greater than the predetermined torque set in the torque limiter 73. Therefore, the rotation of the pressure roller 70, relative to the pressure roller shaft 71, in the feed-out direction of the paper-sheet P, is allowed.

Thus, as shown in FIG. 5(*a*), the pressure roller 70 will be rotated together with the feed roller 60, against the rotation of the pressure roller shaft 71.

Thereafter, as shown in FIG. 5(*b*), when one paper-sheet P is fed to the nip part N between the feed roller 60 and the pressure roller 70, frictional torque exerted between the rubber provided around the outer circumference of the base part 62 of the feed roller 60 and the paper-sheet P as well as exerted between the rubber provided around the outer circumference of the pressure roller 70 and the paper-sheet P. At this time, both the frictional torque generated between the rubber of the feed roller 60 and the paper-sheet P and the frictional torque generated between the rubber of the pressure roller 70 and the paper-sheet P, at the nip part N, are greater than the predetermined torque applied from the torque limiter 73. Therefore, also in this case, the rotation of the pressure roller 70, relative to the pressure roller shaft 71, in the feed-out direction of the paper-sheet P, is allowed. Thus, as shown in FIG. 5(*b*), the pressure roller 70 will be rotated together with the feed roller 60, against the rotation of the pressure roller shaft 71.

However, if two paper-sheets P are accidentally kicked out by the kicker roller 80, while being overlapped with each other, such two overlapped paper-sheets P will be fed to the nip part N between the feed roller 60 and the pressure roller 70, as shown in FIG. 5(*c*). In such a case, the frictional torque is exerted between the rubber of the feed roller 60 and one of the two paper-sheets P as well as exerted between the rubber of the pressure roller 70 and the other of the paper-sheets P. Furthermore, the frictional torque is also exerted between such a pair of overlapped paper-sheets P. Namely, when such two overlapped paper-sheets P are fed to the nip part N, the torque applied to the pressure roller 70 in the circumferential direction thereof will be the frictional torque exerted between the pair of paper-sheets P. However, such frictional torque exerted between the pair of paper-sheets P is significantly less than the predetermined torque set in the torque limiter 73. Therefore, the rotation of the pressure roller 70 in the feed-out direction of the paper-sheet P, relative to the pressure roller shaft 71, will not be allowed by the torque limiter 73 and the pressure roller 70 will be interlocked with the pressure roller shaft 71. In other words, the pressure roller 70 will be rotated in the direction reverse to the feed-out direction of the paper-sheet P. Consequently, the one of the two overlapped paper-sheets P, on the side of the feed roller 60, will be fed out from the nip part N, in the right direction in FIG. 5, while being moved together with the rotation of the feed roller 60. Meanwhile, the other of the two overlapped paper-sheets P, on the side of the pressure roller 70, will not be fed out from the nip part N, due to the rotation of the pressure roller 70 in the direction reverse to the feed-out direction of the paper-sheet P.

However, there are various problems still remaining in such a conventional paper-sheet feeding device. First, it is necessary to provide the pressure roller shaft drive transmission mechanism, in order to drive the pressure roller shaft to be continuously rotated. Therefore, the construction of the paper-sheet feeding device becomes considerably complicated, thus increasing the production cost. Secondly, as shown in FIG. 5, even in the case except that two or more paper-sheets P are fed, accidentally, at a time, to the nip part N, i.e., even in the case in which the paper-sheets P are fed, normally, one by one, to the nip part N, slipping against the torque exerted from the torque limiter 73 always occurs between the pressure roller 70 and the pressure roller shaft 71. Therefore, in such a conventional paper-sheet feeding device, considerably high durability should be required for the torque limiter 73, thus rendering such a torque limiter 73 quite expensive.

Additionally, in the conventional paper-sheet feeding device, for example, when the two paper-sheets P are fed, accidentally, at a time, to the nip part N, after the paper-sheets P are fed, normally, one by one, to the nip part N, as shown in FIG. 5(*b*), the direction of rotation of the pressure roller 70 relative to the pressure roller shaft 71 will be changed from the feed-out direction into the direction reverse to the feed-out direction (i.e., a feed-in direction). Therefore, such a switching operation for the rotational direction of the pressure roller 70 takes additional time, making it difficult to achieve desired increase of the feed-out speed of the paper-sheets P.

SUMMARY OF THE INVENTION

The present invention was made in view of the problems as described above. Therefore, it is an object of the present invention to provide an improved paper-sheet feeding device that can eliminate the need for providing the aforementioned drive transmission mechanism for rotating the pressure roller as well as applying a torque limiter having a relatively low durability to the pressure roller, thereby simplifying the entire construction of the device as well as achieving significant cost reduction and desired increase of the feed-out speed of the paper-sheets.

The present invention is a paper-sheet feeding device comprising: a feed roller configured to be continuously rotated, upon feeding a paper-sheet, wherein the feed roller has a feed roller friction part provided around an outer circumferential surface thereof and configured to be in contact with a surface of the paper-sheet, thereby feeding the paper-sheet; a pressure roller configured to be pressed against the feed roller and forming a nip part, together with the feed roller, wherein the pressure roller has a pressure roller friction part provided around an outer circumferential surface thereof and having a smaller coefficient of friction against the paper-sheet, as compared with the coefficient of friction between the feed roller friction part and the paper-sheet; a pressure roller shaft provided to extend along an axis of the pressure roller and configured not to be rotated in a feed-out direction of the paper-sheet; and a torque limiter provided between the pressure roller and the pressure roller shaft and configured to allow the pressure roller to be rotated in the feed-out direction of the paper-sheet, relative to the pressure roller shaft, when a torque greater than a predetermined torque is applied to the pressure roller along a circumferential direction thereof, while interlocking the pressure roller with the pressure roller shaft, when the torque applied to the pressure roller along the circumferential direction thereof is less than the predetermined torque, wherein the predetermined torque is set less than a frictional torque directly generated between the feed roller friction part and the pressure roller friction part at the nip part, while being set greater than both the frictional torque generated between the pressure roller friction part and the paper-sheet at the nip part and the frictional torque generated between a pair of paper-sheets at the nip part.

According to this paper-sheet feeding device, the pressure roller is rotated together with the feed roller, when no paper-sheet is fed to the nip part between the feed roller and the pressure roller. Meanwhile, when one paper-sheet is fed to the nip part, the pressure roller will be interlocked with the pressure roller shaft, while not being rotated in the feed-out direction. In this case, since the coefficient of friction between the feed roller friction part and the paper-sheet is greater than the coefficient of friction between the pressure roller friction part and the paper-sheet, the one paper-sheet will be fed out from the nip part, while being moved together with the rotation of the feed roller. Again, the pressure roller will be interlocked with the pressure roller shaft, while not being rotated in the feed-out direction, when two or more paper-sheets are accidentally fed to the nip part, while being overlapped with one another. In this case, one paper-sheet, positioned nearest to the feed roller, among such a plurality of overlapped paper-sheets, will be fed out from the nip part, while being moved together with the rotation of the feed roller. However, at this time, the other paper-sheets are not fed out from the nip part.

In this manner, according to the paper-sheet feeding device of this invention, there is no need for providing any drive transmission mechanism for driving the pressure roller to be rotated. Therefore, the construction of such a paper-sheet feeding device can be significantly simplified, leading to substantial cost reduction. Additionally, only in a period of time during which no paper-sheet is fed between the feed roller and the pressure roller, slipping against the torque exerted from the torque limiter occurs between the pressure roller and the pressure roller shaft. Therefore, even such a torque limiter as one having relatively low durability can be applied to this paper-sheet feeding device, thus significantly reducing the cost required for the torque limiter. Furthermore, as compared with the case in which the rotational direction of the pressure roller is switched from the feed-out direction of the paper-sheet to the reverse direction thereof, relative to the pressure roller shaft, during the feed-out operation, the operational mode of the pressure roller in the paper-sheet feeding device of this invention should only be changed from a mode of rotation in the feed-out direction of the paper-sheet into a stopped condition, relative to the pressure roller shaft. Therefore, the time required for switching the operational mode can be reduced. Accordingly, the speed for feeding the paper-sheets can be increased, as compared with the conventional device.

In the paper-sheet feeding device of this invention, it is preferred that a one-way clutch is provided to the pressure roller shaft, wherein the one-way clutch is configured to allow the pressure roller shaft to be rotated only in the direction reverse to the feed-out direction of the paper-sheet. With such a one-way clutch, the pressure roller can be rotated together with the feed roller, also in the case in which the feed roller is rotated in the feed-in direction of the paper-sheet, thus enabling this paper-sheet feeding device to perform a desired feed-in operation for the paper-sheets.

In the paper-sheet feeding device of this invention, it is preferred that the pressing force for pressing the pressure roller against the feed roller is set within a range of 3.92N to 7.84N (0.8813 lbf to 1.7625 lbf), wherein the predetermined torque applied from the torque limiter is set within a range of 0.0686 N·m to 0.1078N·m (0.0506 lb·ft to 0.0795 lb·ft). If the predetermined torque is unduly large, the pressure roller may be interlocked with the pressure roller shaft, even when no paper-sheet is fed to the nip part and thus the feed roller friction part of the feed roller is directly contacted with the pressure roller friction part of the pressure roller. In such a case, the pressure roller would remain in a stationary condition, even though the feed roller is rotated in the feed-out direction of the paper-sheet. Thus, some friction would be always generated between the feed roller friction part of the feed roller and the pressure roller friction part of the pressure roller, leading to considerable wear of the feed roller friction part and/or pressure roller friction part in a shorter time. In contrast, if the predetermined torque T is unduly small, the pressure roller may be rotated in the feed-out direction of the paper-sheet, relative to the paper-sheet roller shaft, even in a period of time during which one paper-sheet is fed through the nip part. Namely, in such a case, slipping against the toque exerted from the torque limiter would occur between the pressure roller and the pressure roller shaft, even in the period of time during which the one paper-sheet is fed through the nip part. Therefore, the life span of the torque limiter may be considerably shortened. It is noted that the paper-sheet feeding device of this invention can be applied to various paper-sheets, specifically Japanese and/or US banknotes as well as banknotes of the other countries in the world or paper-sheets other than the banknotes, such as checks or the like, each having different thickness and/or quality of the material, by changing the pressing force of the pressure roller against the feed roller and/or altering the predetermined torque applied from the torque limiter.

DETAILED DESCRIPTION OF THE INVENTION

Figure 1:
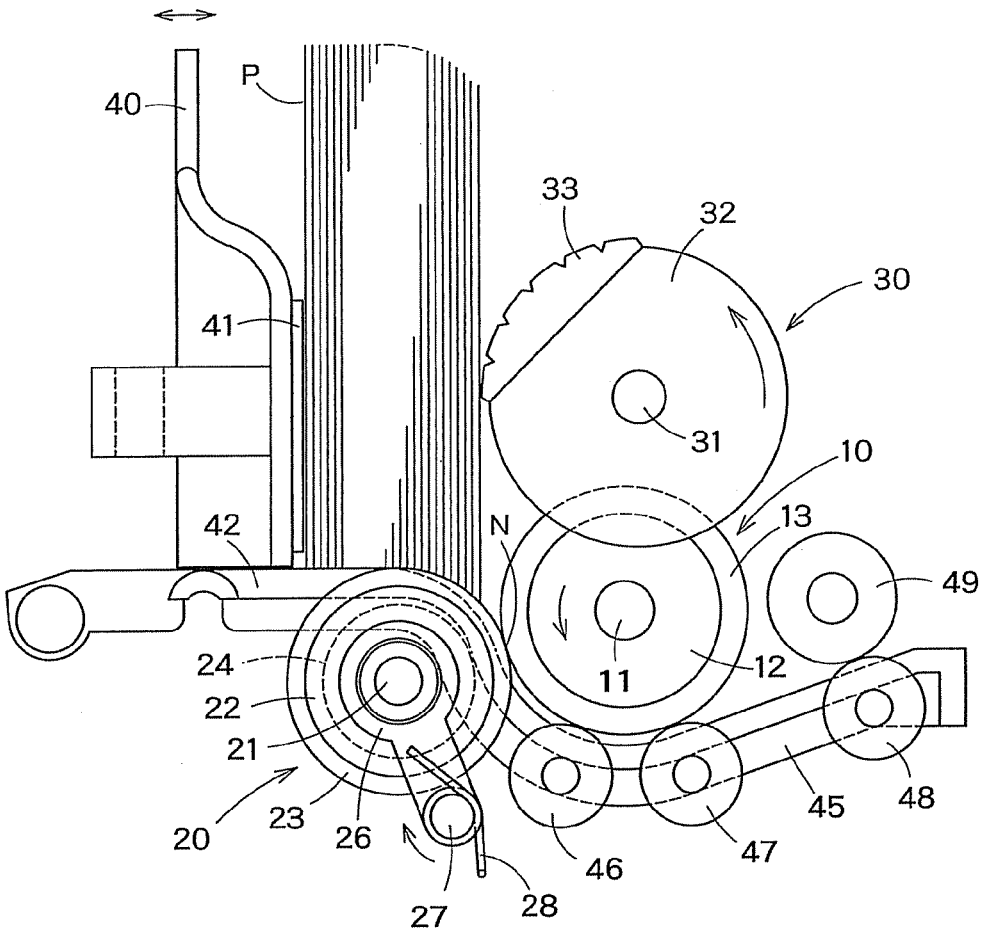
FIG. 1 is a side view showing construction of a paper-sheet storing and feeding device related to one embodiment of the present invention.
Figure 2:
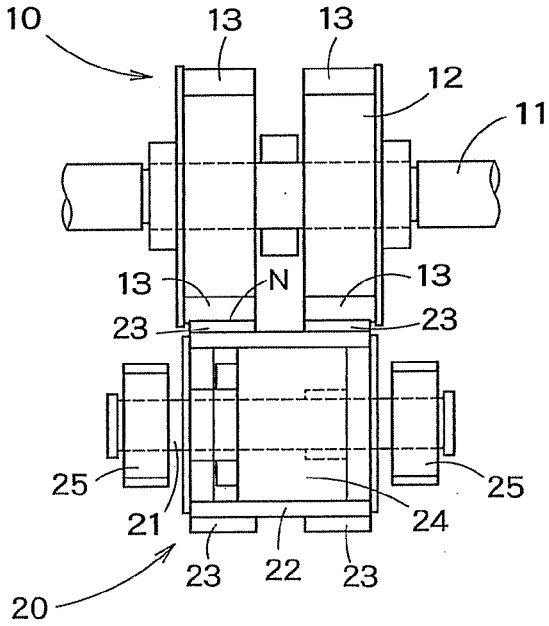
FIG. 2 is a front view showing construction of a feed roller and a pressure roller in the paper-sheet storing and feeding device shown in FIG. 1.
Figure 3:
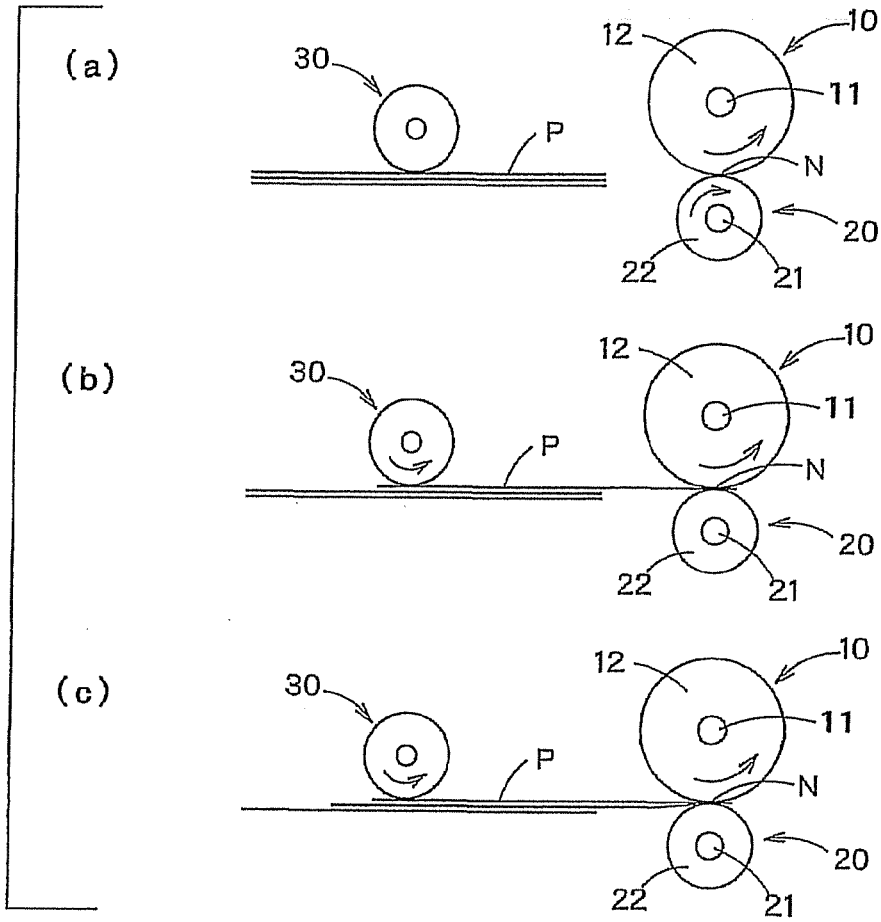
FIG. 3 is a diagram for schematically illustrating a state when the paper-sheet is fed out from the paper-sheet feeding and storing device shown in FIG. 1, wherein FIG. 3(*a*) is a schematic view showing a state in which no paper-sheet is fed to a nip part between the feed roller and the pressure roller, FIG. 3(*b*) is a schematic view showing another state when one paper-sheet is fed to the nip part between the feed roller and the pressure roller, and FIG. 3(*c*) is a schematic view illustrating still another state when two paper-sheets are fed to the nip part between the feed roller and the pressure roller, while being overlapped with each other.
Figure 4:
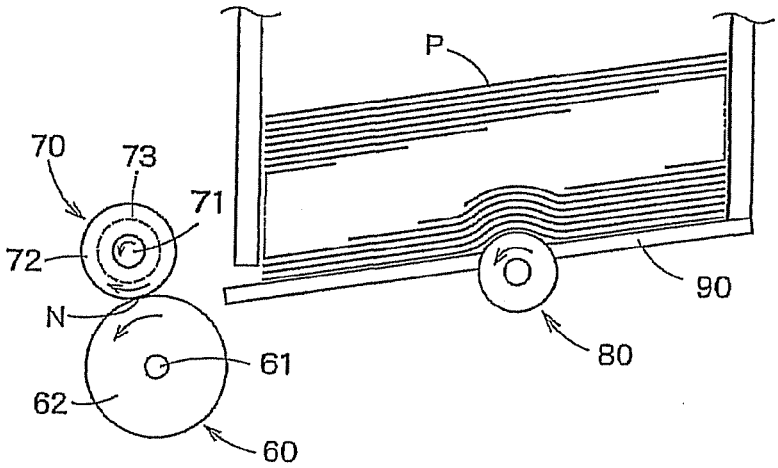
F I G. 4 PRIOR ART
FIG. 4 is a side view schematically showing construction of a conventional paper-sheet feeding device.
Figure 5:
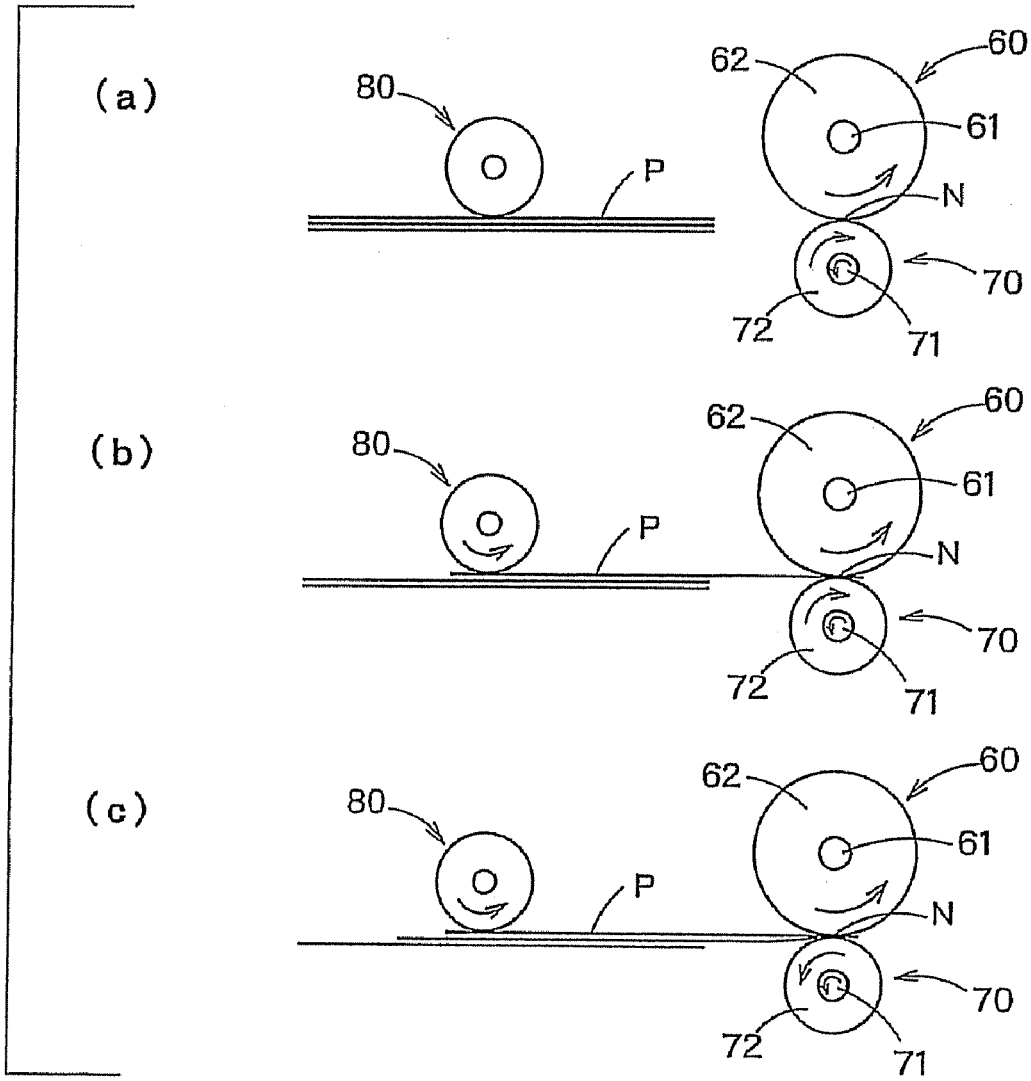
FIG. 5 PRIOR ART
FIG. 5 is a diagram for schematically illustrating a state when the paper-sheet is fed out from the paper-sheet feeding device shown in FIG. 4, wherein FIG. 5(*a*) is a schematic view showing a state before the paper-sheet is fed to the nip part, FIG. 5(*b*) is a schematic view showing another state when one paper-sheet is fed to the nip part between the feed roller and the pressure roller, and FIG. 5(*c*) is a schematic view illustrating still another state when two paper-sheets are fed to the nip part between the feed roller and the pressure roller, while being overlapped with each other.

Hereinafter, one embodiment of the present invention will be described with reference to the drawings. FIGS. 1 to 3 are diagrams, respectively showing the embodiment, in which the paper-sheet feeding device according to the present invention is applied to a paper-sheet storing and feeding device.

General construction of the paper-sheet storing and feeding device of this embodiment, specific construction of each component thereof, operations and effects thereof, and variations and modifications thereof will be described below, successively.

First, the general construction of the paper-sheet storing and feeding device of this embodiment will be described.

As shown in FIG. 1, the paper-sheet storing and feeding device comprises a table 42 configured for placing thereon a plurality of paper-sheets P (e.g., banknotes or the like) in a standing position, and a kicker roller 30 configured to be in contact with a surface of the forefront paper-sheet P among the plurality of paper-sheets P placed in a stacked condition on the table 42 then kick out the forefront paper-sheet P. Below the kicker roller 30, a pair of left and right feed rollers 10, each adapted for feeding out each paper-sheet P kicked out by the kicker roller 30, and a pressure roller 20 configured to be in contact with and pressed against each feed roller 10 and form a nip part N, together with the feed rollers 10, are provided, respectively. Above the table 42, a holding member 40 is provided backwardly (or left in FIG. 1) away from the kicker roller 30. The holding member 40 is configured to hold the plurality of paper-sheets P between this member 40 and the kicker roller 30 in order to keep these paper-sheets P in the standing and stacked condition.

Below the feed roller 10, a guide member 45 configured for guiding each paper sheet P fed out from the nip part N is provided. Additionally, a pair of left and right first grip rollers 46 and a pair of left and right second grip rollers 47 are contacted with the feed rollers 10, respectively. The first grip rollers 46, the second grip rollers 47 and the feed rollers 10 are respectively configured for further carrying each paper-sheet P fed out from the nip part N. In the vicinity of the feed rollers 10, a pair of left and right third grip rollers 48 and a pair of left and right carrier rollers 49 respectively contacted with the third grip rollers 48, are provided, respectively. The third grip rollers 48 and carrier rollers 49 are respectively configured for carrying out each paper-sheet P fed out from another nip part formed between the feed rollers 10 and the second grip rollers 47.

Hereinafter, each component of the paper-sheet storing and feeding device will be described in more detail.

The kicker roller 30, as shown in FIG. 1, is configured to be in contact with the forefront paper-sheet P among the plurality of paper-sheets P in the stacked condition, and continuously rotated in a direction designated by an arrow as depicted in FIG. 1, upon feeding out each paper-sheet P. The kicker roller 30 includes a base part 32 having a substantially disk-like shape and formed from, for example, a plastic or metal, and a rubber 33 provided to a part of an outer circumference of the base part 32 and configured to kick out the forefront paper-sheet P. Along an axis of the kicker roller 30, a kicker roller shaft 31 for pivoting the kicker roller 30 is provided to extend in a vertical direction relative to the sheet of FIG. 1. The rubber 33 is provided to cover, for example, ¼ of an outer circumferential surface of the base part 32. The kicker roller 30 has a diameter of, for example, approximately 40 mm, and a width of, for example, approximately 12 mm.

Each feed roller 10, as shown in FIGS. 1 and 2, is configured to be continuously rotated in a direction designated by another arrow as depicted in FIG. 1, upon feeding out each paper-sheet P. This feed roller 10 includes a base part 12 having a substantially disk-like shape and formed from, for example, a plastic or metal, and a rubber (i.e., a feed roller friction part) 13 provided around the whole outer circumference of the base part 12. Along the axis of the feed roller 10, a feed roller shaft 11 for pivoting the feed roller 10 is provided to extend in the vertical direction relative to the sheet of FIG. 1 (i.e., in left and right directions in FIG. 2). In this case, the rubber 13 is configured to be in contact with the surface of each paper-sheet P kicked out by the kicker roller 30 and then feed out the paper-sheet P. The feed roller 10 has a diameter of, for example, 30 mm, and a width of, for example, approximately 8 mm.

The pressure roller 20, as shown in FIG. 1, is provided to be in contact with and pressed against each feed roller 10. As shown in FIGS. 1 and 2, the pressure roller 20 includes a base part 22 having a substantially disk-like shape and formed from, for example, a plastic or metal, and rubbers (i.e., pressure roller friction parts) 23 respectively provided around the whole outer circumference of the base part 22. Along the axis of the pressure roller 20, a pressure roller shaft 21 for pivoting the pressure roller 20 is provided to extend in the vertical direction relative to the sheet of FIG. 1 (i.e., in the left and right directions in FIG. 2). In this case, the pressure roller 20 has a diameter of, for example, 26 mm, and a width of, for example, approximately 6 mm.

Each rubber 23 of the pressure roller 20 forms the nip part N, together with the rubber 13 of each feed roller 10. The width of each rubber 23 of the pressure roller 20 is set to be slightly smaller than the width of the rubber 13 of each feed roller 10. The coefficient of friction μ1 of each rubber 23 of the pressure roller 20 against each paper-sheet P is less than the coefficient of friction μ2 of the rubber 13 of each feed roller 10 against the paper-sheet P.

As shown in FIG. 1, the pressure roller shaft 21 is supported by a pair of pressure roller support members 26 (only one of the members 26 is shown in FIG. 1) respectively provided to both ends of the shaft 21. Each pressure roller support member 26 includes a head having a substantially disk-like shape and configured for supporting the pressure roller shaft 21, and a proximal end connected with the head. To the proximal end of each pressure roller support member 26, a single fixed shaft 27 is provided to extend in the vertical direction relative to the sheet of FIG. 1. Thus, each pressure roller support member 26 can be optionally rotated about the fixed shaft 27. Holding springs 28 are further provided between each pressure roller support member 26 and the fixed shaft 27. Each holding spring 28 biases the pressure roller support member 26 to be rotated, in a clockwise direction in FIG. 1 (i.e., in a direction designated by another arrow as depicted in FIG. 1), about the fixed shaft 27. With such a pressing force applied from the holding springs 28, the pressure roller 20 supported by the pressure roller support members 26 can be pressed against each feed roller 10. In this way, the nip part N is formed between each rubber 23 of the pressure roller 20 and the rubber 13 of each feed roller 10. In this case, the pressing force P1 applied from the holding springs 28, for pressing the pressure roller 20 against the feed rollers 10, is set within a range of 3.92 N to 7.84 N (0.8813 lbf to 1.7625 lbf).

Between the base part 22 of the pressure roller 20 and the pressure roller shaft 21, a torque limiter 24 is provided. The torque limiter 24 is configured to allow the pressure roller 20 to be rotated, in a feed-out direction of the paper-sheet P, relative to the pressure roller shaft 21, when a torque greater than a predetermined torque T is applied to the pressure roller 20 along the circumferential direction thereof. On the contrary, this torque limiter 24 is configured to interlock the pressure roller 20 with the pressure roller shaft 21, when the torque less than the predetermined torque T is applied to the pressure roller 20 along the circumferential direction thereof. In this case, the predetermined torque T set in the torque limiter 24 is set less than frictional torque N3 directly generated between the rubbers 13 of the feed rollers 10 and the rubbers 23 of the pressure roller 20 at the nip part N, while being set greater than the frictional torque N1 generated between the rubbers 23 of the pressure roller 20 and each paper-sheet P at the nip part N and the frictional torque N4 generated between the two overlapped paper-sheets at the nip part N.

Now, assuming that the coefficient of friction between the rubber 13 of each feed roller 10 and each rubber 23 of the pressure roller 20 is designated by μ3, the aforementioned frictional torque N3 can be expressed by the following equation.

$$N3=\mu 3\times P1 \quad (1)$$

As described above, P1 designates the pressing force of the pressure roller 20 against the feed rollers 10.

Meanwhile, the aforementioned frictional torque N1 can be expressed as follows.

$$N1=\mu 1\times P1 \quad (2)$$

Additionally, assuming that the coefficient of friction between the two overlapped paper-sheets P is designated by μ4, the aforementioned frictional torque N4 can be expressed by the following equation.

$$N4=\mu 4\times P1 \quad (3)$$

Generally, the coefficient of friction μ1 of each rubber 23 of the pressure roller 20 against the paper-sheet P is much greater than the coefficient of friction μ4 between the two overlapped paper-sheets P. Therefore, the predetermined torque T is set at a value satisfying the following formula.

$$\mu 1\times P1<T\div R<\mu 3\times P1 \quad (4)$$

In this formula (4), R denotes a radius (e.g., 13 mm) of the pressure roller 20.

In addition, one-way clutches 25 (see FIG. 2) are provided between the pressure roller shaft 21 and each pressure roller support member 26. Each one-way clutch 25 is configured to allow the pressure roller shaft 21 to be rotated, only in a direction reverse to the feed-out direction of the paper-sheet P. With such provision of the one-way clutches 25, the pressure roller 20 can be freely rotated in one direction (i.e., in a feed-in direction of the paper-sheet P), together with the pressure roller shaft 21, without suffering any influence from the torque limiter 24, when each paper-sheet P is fed in from the outside. Meanwhile, due to such one-way clutches 25, the pressure roller shaft 21 will not be rotated in the feed-out direction, when each paper-sheet P is fed out to the outside.

The holding member 40 is configured to be optionally advanced and retracted, relative to the kicker roller 30, on the table 42 (i.e., the holding member 40 can be moved in the left and right directions in FIG. 1). When the holding member 40 is advanced toward the kicker roller 30 (or moved in the right direction in FIG. 1), the plurality of paper-sheets P placed between the holding member 40 and the kicker roller 30 will be kept in the standing position.

A rubber 41 is attached to a surface, on the side of the kicker roller 30, of the holding member 40, such that the rubber 41 can be in contact with the surface of the rearmost paper-sheet P among the plurality of paper-sheets P placed in the stacked condition on the table 42. Thus, when the holding member 40 is advanced, the rubber 41 will push the plurality of paper-sheets P forward (in the right direction in FIG. 1) and bring them into the standing condition.

It is noted that such a member as one attached to the surface, on the side of the kicker roller 30, of the holding member 40 is not limited to the rubber 41 as described above. For instance, any suitable member, having frictional torque, against the paper-sheet P, greater than the aforementioned frictional torque N4 generated between the two overlapped paper-sheets P, may be used.

Next, an operation of this embodiment constructed as described above will be discussed, with reference to FIGS. 1 to 3.

First, the operation for feeding the plurality of paper-sheets P in the stacked condition, to the outside, successively, one by one, will be described.

First of all, the plurality of paper-sheets P are placed between the holding member 40 and the kicker roller 30 on the table 42. Then, the holding member 40 is advanced toward the kicker roller 30 (or moved in the right direction in FIG. 1). Consequently, the paper-sheets P are held between the holding member 40 and the kicker roller 30, so as to take the standing position.

In this case, the holding member 40 is pressed from the back on the table 42, such that it can be always advanced toward the kicker roller 30. Accordingly, even after a part of the paper-sheets P, among the paper-sheets P in the stacked condition, are kicked out by the kicker roller 30, the remaining paper-sheets P can be always kept in the standing position.

In this way, once the paper-sheets P are stacked in the standing position by the holding member 40, the kicker roller 30 and feed rollers 10 are rotated, in the directions designated by the arrows depicted in FIG. 1, respectively. Due to the continuous rotation of the kicker roller 30, the rubber 33 is in contact with the forefront paper-sheet P, among the paper-sheets P in the stacked condition. As a result, this forefront paper-sheet P is kicked out downward.

The paper-sheet P kicked out downward by the kicker roller 30 is then fed to the nip part N formed between the rubber 13 of each feed roller 10 and each rubber 23 of the pressure roller 20. Now, referring to FIG. 3, a feed-out operation for the paper-sheet P at the nip part N will be detailed. In FIG. 3, the feed-out direction of the paper-sheet P is the right direction.

FIG. 3(*a*) is a schematic view showing a state in which no paper-sheet P is fed to the nip part N between the feed rollers 10 and the pressure roller 20. In this case, as described above, each feed roller 10 is continuously rotated in the feed-out direction of the paper sheet P, while being pressed against the pressure roller 20. Thus, the pressure roller 20 is rotated together with the feed rollers 10, while receiving the pressing torque from the rotating feed rollers 10. This torque exerted on the pressure roller 20, for rotating it together with the feed rollers 10 (i.e., the torque applied to the pressure roller 20 along the circumferential direction thereof) corresponds to the frictional torque N3 directly generated between the rubbers 13 of the feed rollers 10 and the rubbers 23 of the pressure roller 20 at the nip part N. Since such torque applied to the pressure roller 20, for rotating it together with the feed rollers 10, is greater than the predetermined torque T set in the torque limiter 24, the rotation of the pressure roller 20 in the feed-out direction of the paper-sheet P, relative to the pressure roller shaft 21, is allowed. Thus, the pressure roller 20 will be rotated together with the feed rollers 10 in the direction designated by an arrow as depicted in FIG. 3(*a*).

Thereafter, as shown in FIG. 3(*b*), when one paper-sheet P is fed to the nip part N between the feed rollers 10 and the pressure roller 20, a frictional torque N2 exerted between the rubbers 13 of the feed rollers 10 and the paper-sheet P, while a frictional torque N1 is exerted between the rubbers 23 of the pressure roller 20 and the paper-sheet P. At this time, as described above, the predetermined torque T set in the torque limiter 24 is set at a value greater than the frictional torque N1 generated between the rubbers 23 of the pressure roller 20 and the paper-sheet P at the nip part N. Thus, the rotation of the pressure roller 20 in the feed-out direction of the paper-sheet P, relative to the pressure roller shaft 21, will not be allowed and the pressure roller 20 will be interlocked with the pressure roller shaft 21. Additionally, the rotation of the pressure roller shaft 21 in the feed-out direction of the paper-sheet P is prevented by the one-way clutches 25. Therefore, as shown in FIG. 3(*b*), both of the pressure roller shaft 21 and pressure roller 20 will be no longer rotated, while being brought into a stationary state. Furthermore, as described above, since the coefficient of friction μ2 of the rubber 13 of each feed roller 10 relative to the paper-sheet P is greater than the coefficient of friction μ1 of each rubber 23 of the pressure roller 20 relative to the paper-sheet P, the frictional torque N2 between the rubbers 13 of the feed rollers 10 and the paper-sheet P at the nip part N is greater than the frictional torque N1 between the rubbers 23 of the pressure roller 20 and the paper-sheet P. Thus, the paper-sheet P will be fed out in the right direction in FIG. 3 from the nip part N, while being moved together with the rotation of the feed rollers 10.

However, when two paper-sheets P are kicked out, accidentally, while being overlapped with each other, by the kicker roller 30, as shown in FIG. 3(*c*), such two overlapped paper-sheets P will be fed to the nip part N between the feed rollers 10 and the pressure roller 20. In this case, the frictional torque N2 is exerted between the rubbers 13 of the feed rollers 10 and one of the two paper-sheets P, while the frictional torque N1 is exerted between the rubbers 23 of the pressure roller 20 and the other of the paper-sheets P. In addition, the frictional torque N4 is generated between the two overlapped paper-sheets P. As described above, since the coefficient of friction μ4 between the two overlapped paper-sheets P is significantly less than the coefficient of friction μ1 between each rubber 23 of the pressure roller 20 and the paper-sheet P, the frictional torque N4 exerted between the two overlapped paper-sheets P will also be significantly less than the frictional torque N1 generated between the rubbers 23 of the pressure roller 20 and the paper-sheet P.

Accordingly, in the case in which such two overlapped paper-sheets P are fed together to the nip part N between the feed rollers 10 and the pressure roller 20, the torque applied to the pressure roller 20 along its circumferential direction will be the frictional torque N4 exerted between the two overlapped paper-sheets P. However, as described above, since this frictional torque N4 is less than the predetermined torque T exerted from the torque limiter 24, the rotation of the pressure roller 20 in the feed-out direction of the paper-sheet P, relative to the pressure roller shaft 21, will not be allowed and the pressure roller 20 will be interlocked with the pressure roller shaft 21. Accordingly, also in this case, as shown in FIG. 3(*c*), both of the pressure roller shaft 21 and pressure roller 20 will be no longer rotated, while being brought into the stationary state. In addition, since the frictional torque N2 between the rubbers 13 of the feed rollers 10 and the paper-sheet P at the nip part N is greater than the frictional torque N4 exerted between the two overlapped paper-sheets P, the one paper-sheet P, on the side of the feed rollers 10, of the two overlapped paper-sheets P, will be fed out in the right direction in FIG. 3, while being moved together with the rotation of the feed rollers 10. Meanwhile, the other paper-sheet P, on the side of the pressure roller 20, of the two overlapped paper-sheets P, will not be fed out from the nip part N, because the pressure roller 20 is brought into the stationary state.

Thereafter, the paper-sheet P fed out from the nip part N between the feed rollers 10 and the pressure roller 20 will be carried by the first grip rollers 46 and second grip rollers 47 along the guide member 45, and finally carried out from another nip part between the third grip rollers 48 and carrier rollers 49.

Next, an operation, for storing the plurality of paper-sheets P successively fed in from the outside as well as for bringing them into the stacked condition, will be discussed, with respect to the paper-sheet storing and feeding device of this embodiment.

First, the paper-sheets P are inserted, one by one, between the third grip rollers 48 and carrier rollers 49. Each of the inserted paper-sheets P is then fed, along the guide member 45, to the nip part N between the feed rollers 10 and the pressure roller 20. In this case, each feed roller 10 is continuously rotated in the direction reverse to the direction designated by the arrow depicted in FIG. 1.

Thereafter, a feed-in operation for the paper-sheets P successively fed to the nip part N is performed, one by one, by the feed rollers 10. As described above, the one-way clutches 25, which are provided to the pressure roller shaft 21 for pivoting the pressure roller 20, is configured to allow the pressure roller shaft 21 to be rotated in the direction reverse to the feed-out direction of the paper-sheet P, i.e., in the feed-in direction of the paper-sheet P. Again, since each feed roller 10 is pressed against the pressure roller 20, the pressure roller 20 will be rotated together with the feed rollers 10. As a result, the pressure roller 20 will be rotated in a counterclockwise direction in FIG. 1. In this way, the paper-sheet P fed to the nip part N between the feed rollers 10 and the pressure roller 20 will be further fed onto the table 42, smoothly and successively.

Thereafter, the plurality of paper-sheets P successively fed and stacked onto the table 42 will be held in the standing position between the holding member 40 and the kicker roller 30.

As discussed above, according to the paper-sheet storing and feeding device of this embodiment, the torque limiter 24 is provided between the pressure roller 20 and the pressure roller shaft 21. In this case, the torque limiter 24 is configured to allow the pressure roller 20 to be rotated, in the feed-out direction of the paper-sheet P, relative to the pressure roller shaft 21, when the torque greater than the predetermined torque T is applied to the pressure roller 20 along the circumferential direction thereof. In addition, this torque limiter 24 is configured to interlock the pressure roller 20 with the pressure roller shaft 21, when the torque less than the predetermined torque T is applied to the pressure roller 20 along the circumferential direction thereof. The predetermined torque T is set at a value less than the frictional torque N3 directly generated between the rubbers 13 of the feed rollers 10 and the rubbers 23 of the pressure roller 20 at the nip part N, while being set greater than both of the frictional torque N1 generated between the rubbers 23 of the pressure roller 20 and the paper-sheet P at the nip part N and the frictional torque N4 generated between the two overlapped paper-sheets P at the nip part N. Furthermore, the pressure roller shaft 21 is configured not to be rotated in the feed-out direction of the paper-sheet P. Therefore, as described above, when no paper-sheet P is fed to the nip part N between the feed rollers 10 and the pressure roller 20, the pressure roller 20 is rotated together with the feed rollers 10. Meanwhile, when one paper-sheet P is fed to the nip part N, the pressure roller 20 will be interlocked with the pressure roller shaft 21. Thus, the pressure roller 20 will be no longer rotated in the feed-out direction of the paper-sheet P. In this case, since the coefficient of friction μ1 between the rubber 13 of each feed roller 10 and the paper-sheet P is greater than the coefficient of friction μ2 between each rubber 23 of the pressure roller 20 and the paper-sheet P, the paper-sheet P will be fed out from the nip part N together with the rotation of the feed roller 10. Similarly, when the two or more paper-sheets P are fed to the nip part N, while being overlapped with one another, the pressure roller 20 will be interlocked with the pressure roller shaft 21 and thus will no longer be rotated in the feed-out direction of the paper-sheet P. In this case, the one paper-sheet P nearest to the feed rollers 10, among such two or more overlapped paper-sheets P, will be fed out from the nip part N, while being moved together with the rotation of the feed rollers 10. However, at this time, the other paper-sheets P are not fed out from the nip part N.

In this manner, according to the paper-sheet storing and feeding device of this embodiment, there is no need for providing any special drive transmission mechanism for driving the pressure roller 20 to be rotated. This can significantly simplify the construction of the paper-sheet storing and feeding device, leading to a cost reduction. In addition, only in the period of time during which no paper-sheet is fed between the feed rollers 10 and the pressure roller 20, slipping against the torque exerted from the torque limiter 24 occurs between the pressure roller 20 and the pressure roller shaft 21. Therefore, even such a torque limiter 24 as one having relatively low durability can be applied to this paper-sheet storing and feeding device, thus significantly reducing the cost required for the torque limiter 24. Furthermore, as compared with the conventional device configured for switching the rotational direction of the pressure roller, from the feed-out direction of the paper-sheet to the reverse direction thereof (i.e., the feed-in direction), relative to the pressure roller shaft, during the feed-out operation, the operational mode of the pressure roller 20 of the paper-sheet storing and feeding device of the above embodiment should only be changed from a mode of rotation in the feed-out direction of the paper-sheet P, relative to the pressure roller shaft 21, into the stationary or stopped state. Therefore, the time required for switching the operational mode can be reduced. Thus, the speed for feeding out the paper-sheets P can be increased, as compared with the conventional device.

Additionally, the one-way clutches 25 are provided to the pressure roller shaft 21, wherein the one-way clutches 25 are configured to allow the pressure roller shaft 21 to be rotated only in the direction reverse to the feed-out direction of the paper sheet P. With such a provision of the one-way clutches 25, the pressure roller 20 can be rotated together with the feed rollers 10, in the case in which the feed rollers 10 are rotated in the feed-in direction of the paper-sheet P. As such, a desired feed-in operation for the paper-sheet P can be performed by this paper-sheet storing and feeding device.

Specifically, the predetermined torque T is set within a range of 0.0686 N·m to 0.1078 N·m (0.0506 lb·ft to 0.0795 lb·ft). If the predetermined torque T is unduly large, as compared with the above range, the pressure roller 20 may be interlocked with the pressure roller shaft 21, even when no paper-sheet P is fed to the nip part N and hence the rubber 13 of each feed roller 10 is directly contacted with each rubber 23 of the pressure roller 20. Therefore, in such a case, the pressure roller 20 would remain in the stationary state, at any time, even through the feed rollers 10 are rotated in the feed-out direction of the paper-sheet P. Accordingly, some friction would be always generated between the rubber 13 of each feed roller 10 and each rubber 23 of the pressure roller 20, thus wearing out the rubber 13 and/or rubber 23 in a shorter time. Contrary, if the predetermined torque T is unduly small, the pressure roller 20 may be rotated in the feed-out direction of the paper-sheet P, relative to the pressure roller shaft 21, even in a period of time during which one paper-sheet P is fed through the nip part N. In such a case, abrasive slipping against the toque exerted from the torque limiter 24 would occur between the pressure roller 20 and the pressure roller shaft 21, even in the period of time during which the one paper-sheet P is fed through the nip part N. Therefore, the life span of the torque limiter 24 should be considerably shortened.

It should be appreciated that the paper-sheet storing and feeding device described above can be applied to various paper-sheets P, specifically Japanese and/or US banknotes as well as banknotes of the other countries in the world or paper-sheets P other than the banknotes, such as checks or the like, each having different thickness and/or quality of the material, by changing the pressing force P1 of the pressure roller 20 against the feed rollers 10 and/or adequately adjusting the predetermined torque T set in the torque limiter 24.

In addition, according to the paper-sheet storing and feeding device as described above, both of the feed-out operation and feed-in operation for the paper-sheets P can be performed with the same transport path, thereby substantially downsizing the paper-sheet storing and feeding device.

While the paper-sheet storing and feeding device capable of performing both of the feed-out operation and feed-in operation for the paper-sheets has been discussed with respect to the above embodiment, the present invention is not limited to such an aspect. For instance, this invention is also applicable to the paper-sheet feeding device adapted for feeding out the paper-sheets, successively, one by one, while having no function for feeding in and storing the paper-sheets therein.

While the paper-sheet storing and feeding device related to the above embodiment has been described as one configured to place the plurality of paper-sheets on the table in the vertically standing position, the present invention is not limited to such a type. For instance, this invention can also be applied to the paper-sheet storing and feeding device or paper-sheet feeding device, which is configured to place the plurality of paper-sheets on the table in a horizontally stacked condition.

The invention claimed is:

1. A paper-sheet feeding device, comprising:

a feed roller configured to be continuously rotated, upon feeding a paper-sheet, wherein the feed roller has a feed roller friction part provided around an outer circumferential surface thereof and configured to be in contact with a surface of the paper-sheet, thereby feeding the paper-sheet;

a pressure roller configured to be pressed against the feed roller and form a nip part, together with the feed roller, wherein the pressure roller has a pressure roller friction part provided around an outer circumferential surface thereof and having a smaller coefficient of friction against the paper-sheet, as compared with a coefficient of friction between the feed roller friction part and the paper-sheet;

a pressure roller shaft provided to extend along an axis of the pressure roller and configured not to be rotated in a feed-out direction of the paper-sheet;

a one-way clutch mounted on the pressure roller shaft, wherein the one-way clutch is configured to allow the pressure roller shaft to be rotated only in a direction that is reverse to the feed-out direction of the paper-sheet; and a torque limiter provided between the pressure roller and the pressure roller shaft and configured to allow the pressure roller to be rotated in the feed-out direction of the paper-sheet, relative to the pressure roller shaft, when a torque greater than a predetermined torque is applied to the pressure roller along a circumferential direction thereof, while interlocking the pressure roller with the pressure roller shaft, when the torque applied to the pressure roller along the circumferential direction thereof is less than the predetermined torque, wherein the predetermined torque is set less than frictional torque directly generated between the feed roller friction part and the pressure roller friction part at the nip part, while being set greater than both the frictional torque generated between the pressure roller friction part and the paper-sheet at the nip part, and the frictional torque generated between a pair of paper-sheets at the nip part.

2. The paper-sheet feeding device according to claim 1, wherein pressing force for pressing the pressure roller against the feed roller is set within a range of 3.92 N to 7.84 N (0.8813 lbf to 1.7625 lbf), and wherein the predetermined torque applied from the torque limiter is set within a range of 0.0686 N·m to 0.1078 N·m (0.0506 lb·ft to 0.0795 lb·ft).

3. The paper-sheet feeding device according to claim 1, wherein the one-way clutch is mounted on the pressure roller shaft at a position between the pressure roller and a pressure roller support member.

* * * * *